United States Patent [19]

Grossman et al.

[11] Patent Number: 4,629,543

[45] Date of Patent: Dec. 16, 1986

[54] METHOD OF PREPARING MERCURY WITH AN ARBITRARY ISOTOPIC DISTRIBUTION

[75] Inventors: Mark W. Grossman, Belmont; William A. George, Rockport, both of Mass.

[73] Assignee: GTE Products Corporation, Danvers, Mass.

[21] Appl. No.: 815,147

[22] Filed: Dec. 31, 1985

[51] Int. Cl.[4] ..... C25C 1/00

[52] U.S. Cl. ..... 204/105 R

[58] Field of Search ..... 204/105 R

[56] References Cited

U.S. PATENT DOCUMENTS 3,639,222 2/1972 Scheiner et al. ..... 204/105 R 3,673,406 6/1972 Nief et al. ..... 250/43

OTHER PUBLICATIONS

*Photochemical Isotope Separation of HG-196 by Reaction with Hydrogen Halides,* Webster, C. R. and Zare, R. N., J. Phy. Chem., 85, 1302–1305 (1981).

*Photochemical Enrichment of Hg-196,* Grossman, M., and Maya, J., XIII, Intern. Elec. Con. Tech. Dig., 139–140 (Jun. 18–21, 1984).

*Energy Conservation Through More Efficient Conservation,* Maya, J., Grossman, M. W., Lagushenko, R., Waymouth, J. F., Science, 226, 435–436 (Oct. 26, '84).

*Primary Examiner*—R. L. Andrews

*Attorney, Agent, or Firm*—Hamilton, Brook, Smith & Reynolds

[57] ABSTRACT

This invention provides for a process for preparing mercury with a predetermined, arbitrary, isotopic distribution. In one embodiment, different isotopic types of $Hg_2Cl_2$, corresponding to the predetermined isotopic distribution of Hg desired, are placed in an electrolyte solution of HCl and $H_2O$. The resulting mercurous ions are then electrolytically plated onto a cathode wire producing mercury containing the predetermined isotopic distribution. In a similar fashion, Hg with a predetermined isotopic distribution is obtained from different isotopic types of HgO. In this embodiment, the HgO is dissolved in an electrolytic solution of glacial acetic acid and $H_2O$. The isotopic specific Hg is then electrolytically plated onto a cathode and then recovered.

17 Claims, 1 Drawing Figure

METHOD OF PREPARING MERCURY WITH AN ARBITRARY ISOTOPIC DISTRIBUTION

GOVERNMENT RIGHTS

The Government has rights in this invention pursuant to Subcontract 4524210 under Prime Contract DE-AC03-76SF00098 awarded by the U.S. Department of Energy.

FIELD OF THE INVENTION

This invention is in the field of inorganic chemistry. More particularly it relates to the preparation of mercury with a predetermined arbitrary isotopic distribution from mercury compounds. This is done via electrolytic means.

BACKGROUND OF THE INVENTION

Many devices require that various amounts of mercury be included therein for their operation. Such a device is the arc discharge lamp which comes in many varieties. Virtually all of these lamps employ mercury as one of the vaporizable components. In current commercial lamps, such as fluorescent lamps, it is common practice to mechanically dispense a drop of natural mercury into the lamp.

This practice of mechanically dispensing mercury or other material works well because natural mercury is a fairly inexpensive commodity costing about \$0.30/gram. A mercury droplet can be placed within a small capsule which is placed in a lamp and opened after the lamp is sealed. See U.S. Pat. No. 3,913,999.

Recently it has been determined that the efficiency of low pressure mercury-rare gas discharge lamps can be enhanced if the isotopic mixture of the mercury is changed from that which occurs naturally. See, for example, Electric Discharge Lamps, MIT Press, 1971, by J. Waymouth for basic principles of low pressure mercury rare gas discharge lamps and U.S. Pat. No. 4,379,252. The latter patent teaches efficiency gains in fluorescent lamps when the $^{196}$Hg isotope is increased from its natural occurrence of about 0.14% to about 3%.

The problem of employing such altered compounds of mercury lies in their expense. For example, at current prices, mercury which has been enhanced to contain 35% of the $^{196}$Hg isotope, costs about \$500/milligram (mg). Accordingly, it can be seen that use of this material requires very strict controls on the amount of Hg employed. Further, such materials need only be used in submilligram amounts. Nearly isotopically pure $^{i}$HgO (85 to 96%, excluding $^{196}$HgO which is generally 25 to 50% pure) can be mixed in milligram or larger quantities, and then thermally decomposed to form milligram quantities of liquid mercury. In order to reach a particular isotopic distribution, a definite amount of each $^{i}$HgO powder must be metered and combined with other isotopically pure $^{i}$HgO. With small quantities of HgO, this can be a difficult and time consuming process.

Additional, thermal decomposition requires elevated temperatures T>500° C. Under high vacuum conditions, this process can easily result in the introduction of trace impurities into mercury. Furthermore, vacuum baking at high temperatures requires hardware and techniques that are very complex.

SUMMARY OF THE INVENTION

This invention provides for a unique and novel process for preparing mercury (Hg) with a predetermined, arbitrary, isotopic distribution.

In one embodiment, specific amounts of different isotopic types of mercurous chloride ($Hg_2Cl_2$), corresponding to the predetermined isotopic distribution of Hg desired, are combined and dissolved in an electrolyte solution of concentrated HCl and $H_2O$ forming mercurous ions $Hg^+$ in solution. In a preferred embodiment, the electrolyte solution is in the relative molar concentration of one mole of HCl/57 moles of $H_2O \pm 20\%$. An anode and a cathode are then placed into the solution. An electric voltage is applied to the anode and the cathode creating an electric current from the anode through the electrolyte solution to the cathode, whereby mercurous ions are reduced and elemental Hg plates onto the cathode. Mercury with the predetermined isotopic distribution is then recovered.

In another embodiment, specific amounts of different isotopic types of mercuric oxide (HgO), corresponding to the predetermined isotopic distribution of Hg desired, are combined and dissolved in an electrolyte solution of glacial acetic acid and $H_2O$ forming mercuric ions $Hg^{2+}$ in solution. In a preferred embodiment, the electrolyte solution is in the relative molar concentration of one mole of glacial acetic acid to 66 moles of $H_2O$. An anode and a cathode are then placed into the solution. The mercuric ions are then reduced and elemental mercury plated onto the cathode by means of an electric voltage which is applied to the anode and the cathode. Mercury with the predetermined isotopic distribution is then recovered.

DETAILED DESCRIPTION OF THE INVENTION

Figure 1:
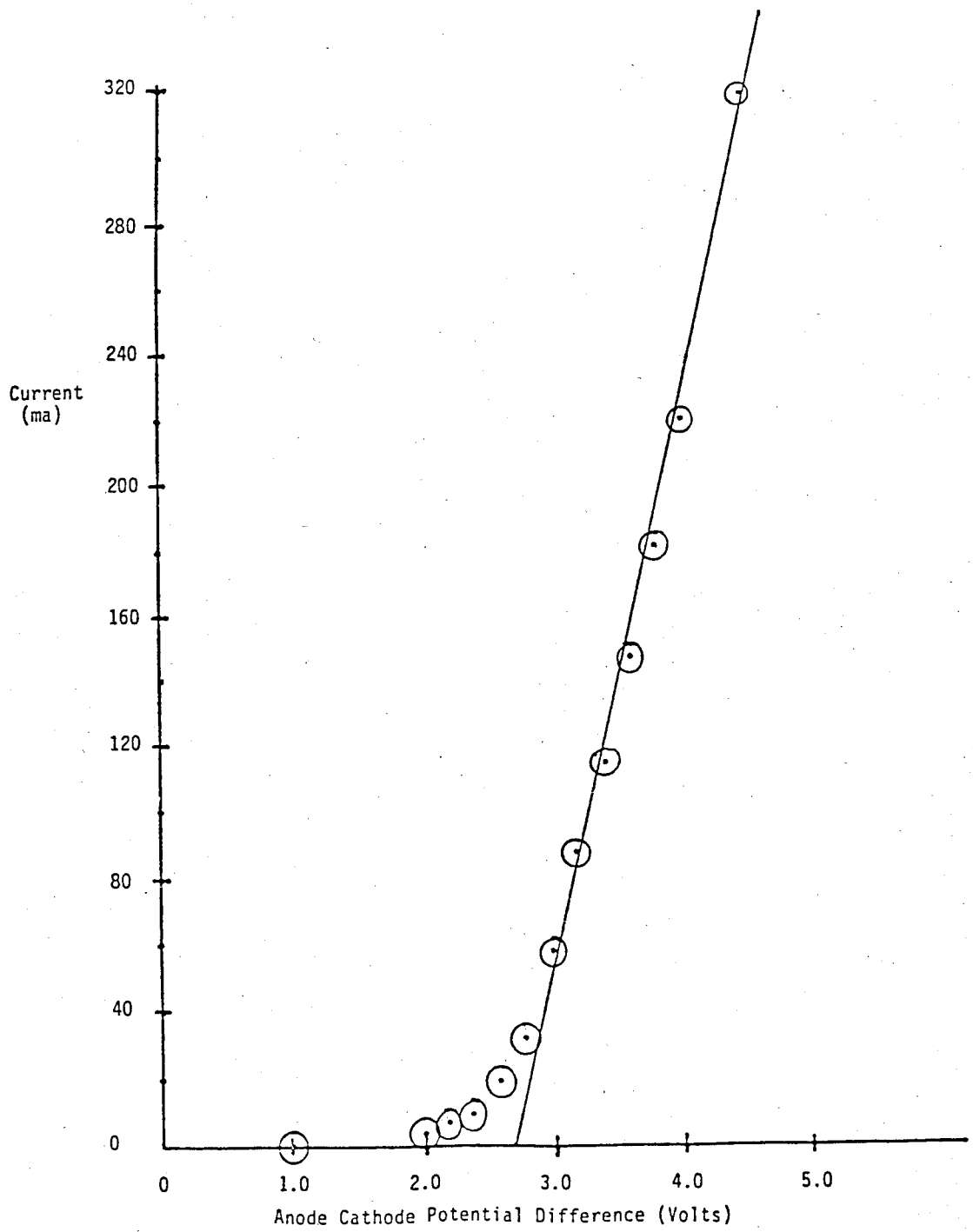
FIG. 1 is a decomposition curve for a dilute HCl solution with excess $Hg_2Cl_2$.

This invention comprises a method for preparing mercury with a predetermined arbitrary isotopic distribution. By a predetermined, arbitrary isotopic distribution of Hg, it is meant that the isotopic distribution of Hg obtained was intentionally chosen and was not a result of a random or natural occurrence resulting in the isotopic distribution obtained.

To obtain a predetermined isotopic distribution of Hg from $Hg_2Cl_2$, a predetermined amount of each type of $Hg_2Cl_2$ is obtained. Each type of $Hg_2Cl_2$ has a specific isotopic content of mercury. The $Hg_2Cl_2$ thus obtained is then combined in an electrolyte solution containing concentrated HCl and $H_2O$ forming mercurous $Hg^{2+}$ ions in solution. In a preferred embodiment, the electrolyte solution has the relative molar concentration of 1 mole of HCl/57 moles of $H_2O \pm 20\%$. The combination of all of the types of $Hg_2Cl_2$ in solution results in a solution containing Hg ions having the isotopic distribution of mercury desired. By diluting a solution containing a particular Hg isotopic content, one can proportion accurately, even for small quantities of Hg ions, a final solution containing a nearly arbitrary isotopic distribution of Hg isotopes having a specific mass within the limits of available $Hg_2Cl_2$ isotopic purity. An anode and a cathode are then placed into the electrolytic solution. An inert wire such as platinum can be used as the anode and the wire to be plated with Hg is used as the cathode.

The cathode wire can be purified copper, nickel or Niron. (Niron is a trademark for a magnetic alloy comprised of about 50% nickel and 50% iron manufactured by Amax Corporation of Orangeburg, S.C.). An electric voltage of 0.9 or higher (as determined by the I–V characteristic of the system) is then applied across the anode and the cathode creating an electric current from the anode through the electrolyte solution to the cathode whereby mercurous ions are reduced and elemental mercury is plated onto the cathode. Voltage of below 1.3 produce good results for unsaturated solutions of $Hg_2Cl_2$ for the types of wire cathodes mentioned above. The electrolyte solution is kept at a temperature of about 25° C. and is stirred during this process to promote dissociation of $Hg_2Cl_2$.

To determine the ideal voltage which should be applied to the electrolyte solution for successful plating, the I–V or decomposition characteristic of the system must be determined. This is determined by plotting the current as a function of voltage as illustrated in FIG. 1. This graph shows two distinct phases. The initial phase depicts a climb in current as a high enough voltage is reached so as to allow the Hg ions to begin to be reduced.

At 0.9 volts, Hg ions start to be reduced. As the voltage is further increased the current climbs very slowly indicating substantial Hg ion reduction. However, when the voltage reaches a certain point, called the breakdown voltage, the current rises sharply indicating that other chemical reactions are occurring at significant rates. The excess voltage causes these additional chemical reactions to occur.

Impurities are produced when the breakdown voltage level is reached. This is due to the electrolyte breakdown which occurs as a consequence of the additional chemical reactions which take place when the breakdown voltage is reached. The fact that the breakdown voltage has been reached can be determined by the fact that there is a steep increase in the current. The ammeter serves as a process parameter check rather than a direct measure of Hg plating rate due to the fact that it signals an increase in current caused by the additional chemical reactions which are occurring.

Most of the decomposition current is due to decomposition of the electrolyte rather than Hg ion reduction. For $Hg_2Cl_2$, even though higher voltages could yield higher deposition rates, it also results in substances other than mercury being plated, so a compromise between plating rate and electrolyte breakdown must be found. The specific value can be determined from the I–V characteristic of the system.

A similar curve results when current is plotted as a function of voltage during the electrolyte reduction of mercuric ion dissociated from HgO in a solution of glacial acetic acid and $H_2O$. However, electrolyte decomposition is not a significant problem during the electrolytic reduction of mercuric ions dissociated from HgO in an electrolyte solution of glacial acetic acid and water. The reduction of mercuric ion obtained from HgO is usually run at 50 ma for milligram and submilligram amounts of HgO. Voltages as high as 17 volts can be used to obtain this amperage resulting in very little electrolyte decomposition.

As mentioned above, from the decomposition curve, it can be determined at what voltage the Hg ions start to be reduced and where the breakdown voltage lies. The voltage between where the Hg ions begin to be reduced and the breakdown voltage lies in the I–V characteristic of the system. It is within this voltage range that optimal plating of Hg is obtained.

To obtain a predetermined isotopic distribution of Hg from HgO, a predetermined amount of each type of HgO is obtained. Each type of HgO has a specific isotopic content of mercury. All of the HgO is then combined in an electrolyte solution containing glacial acetic acid and $H_2O$. Thus, the combination of all of the types of HgO in solution results in a solution containing mercuric ions having the isotopic distribution of mercury desired. By diluting a solution containing a particular Hg isotopic content, one can proportion accurately, even for small quantities of mercuric ions, a final solution containing a nearly arbitrary isotopic distribution of Hg isotopes having a specific mass within the limits of available HgO isotopic purity.

For the recovery of Hg from HgO, an inert wire such as platinum can be used as the anode and the wire to be plated with Hg is used as the cathode. A purified nickel or copper wire can be used as the cathode. To electrolytically recover Hg from HgO, the electrolyte solution used is a mixture of glacial acetic acid and $H_2O$. In a preferred embodiment, the solution is in the relative molar concentration of 1 mole of glacial acetic acid to 66 moles of $H_2O \pm 20\%$. HgO is dissolved into the electrolyte solution and an electric voltage (the specific maximum value being determined by the I–V characteristic of the system) is then applied across the anode and the cathode creating an electric current from the anode through the electrolyte solution to the cathode whereby mercury ions are reduced and elemental mercury is plated onto the cathode.

Due to the fact that a relatively high voltage is required to produce electrolyte decomposition during the reduction of mercuric ions from HgO glacial acetic acid, very little attention is paid to voltage. Instead of voltage, amperage in the parameter which is most carefully monitored to promote the most rapid and complete reduction and plating of mercuric ions. At 50 ma using a cathode which is 2.5 cm long and 0.05 cm in diameter, made of either copper or nickel and a 2.6 cm long 0.05 cm diameter platinum wire as the anode, one obtains rapid and complete reduction and plating of mercuric ions from HgO in glacial acetic acid and $H_2O$. 50 ma is reached by applying about 17 volts across the anode and the cathode.

The electrolyte solution is kept at a temperature of about 25° C. and the solution is stirred to promote HgO dissociation. The electrolytic separation is continued until the reduction of Hg ions is completed. It is considered a complete reduction when 90–99% of the Hg ions, which can theoretically be reduced, have plated onto the cathode.

Thereupon, mercury with the predetermined isotopic distribution is recovered. The HgO plating process appears reproducible and very efficient in removing a very large fraction of Hg ions.

The cathodes used in the separation of mercury from HgO and $Hg_2Cl_2$ form Hg alloys having positive interaction enthalpies ($\Delta H > O$). This implies that the plated Hg will tend to stay as free metal rather than chemically combine with the cathode.

Electrolytic separation of Hg from HgO and $Hg_2Cl_2$ were run for different periods of time. A potentiometric titration method was used to determine the amount of $Hg^{2+}$ ions left in solution at the end of each of the different periods of time. It was thus determined that the reduction of milligram and submilligram amounts of Hg was typically completed in 4–5 hours. For a detailed discussion of the potentiometric titration technique used, see Overman, R.F. *Potentiometric Titration of Mercury Using the Iodide Selective Electrode as Indicator,* Anal. Chem 43 No.4, 616–617 (April 1971) the teachings of which are hereby incorporated by reference.

The invention is further illustrated by the following examples.

EXAMPLE 1

Reduction of Milligram Quantities of Mercury

Materials Used 1.02 mg $^{201}HgO$
2.5 cm long 0.05 cm diameter nickel wire cathode
Glacial acetic acid
$H_2O$
2.5 cm long 0.05 cm diameter platinum anode

Procedure 1.02 mg of $^{201}HgO$ was placed in solution of glacial acetic acid and water containing 19 parts of $H_2O$ for every part of glacial acetic acid. Plating was carried out at about 17 volts for 5.5 hours at 50 ma at 25° C. using a 2.5 cm long 0.05 cm diameter nickel wire cathode and a 2.5 cm long 0.05 cm diameter platinum anode. Using potentiometric titration, it was determined that the remaining solution contained 0.013 mg of mercuric ions which represents an approximate 99% recovery of Hg from the HgO.

EXAMPLE 2

Plating of a Submilligram Quantity of HgO

Materials Used 2.5 cm long 0.05 cm diameter nickel wire cathode
2.5 cm long 0.05 cm diameter platinum wire anode
Glacial acetic acid
$H_2O$
2.56 mg HgO

Procedure 3.56 mg of HgO were dissolved in 100 ml of glacial acetic acid and water. The solution was in the relative molar concentration of 1 mole of glacial acetic acid/66 moles of $H_2O$. 10 ml of this solution were removed. 10 ml of solution contained 0.356 mg of HgO or 0.330 mg of mercuric ions. The platinum anode and the nickel cathode, connected to an appropriate power supply were placed into the 10 ml solution. Plating was carried out for 5.0 hours at 50 ma at a temperature of about 25° C. During the plating process, the temperature rose to about 32° C.

After 5 hours, the plating was stopped and a potentiometric titration was carried out in the remaining solution. It was determined that 0.0299 mg of mercuric ions were remaining in solution. This represented a 91% yield in recovered mercury.

EXAMPLE 3

Preparation Of Mercury With An Arbitrary Isotopic Distribution Of Mercury

Materials Used 2.29 mg natural HgO
0.5 mg $^{204}HgO$
Glacial Acetic Acid
Water
2.5 cm long 0.05 cm diameter nickel wire cathode
2.5 cm long 0.05 cm diameter platinum wire anode

Procedure

It was desired to enrich 2.12 mg of mercury 6.84% of Hg 204 to mercury with a Hg 204 content of 14%. The amount of $^{n}HgO$ needed to form 2.12 mg of $$^{n}\text{Hg was } 2.12 \text{ mg} \times \frac{200 \text{ mg}}{216 \text{ mg}} = 2.29 \text{ mg } ^{n}\text{HgO}$$

The amount of $^{204}HgO$ need to be mixed with 2.29 mg of $^{n}HgO$ to obtain the desired isotopic distribution was determined in the following way.

P=final fraction of desired isotope
X=amount of $^{204}Hg$ to be added to achieve P
C=initial $^{204}Hg$ concentration
I=initial total Hg weight
a=$^{204}Hg$ fraction in enriched HgO sample, which was 91.1% in this case.
d=(2.29) X/a—amount of $^{204}HgO$ sample to be added.

Then $$X = \frac{I(P - C)}{I - P}$$

In this example $$X = \frac{(2.12)(0.140 - 0.068)}{1 - 0.64} = 0.177$$

$$d = 1.08 \times \frac{0.177}{0.9308} = 0.205 \text{ mg } ^{204}\text{HgO}$$

Thus, it was determined that 0.205 mg of $^{204}HgO$ having a 93.08% isotopic content of Hg 204 was needed to be mixed with 2.29 mg of natural Hg to electrolytically produce 2.12 mg of Hg having a Hg 204 content of 14%.

0.205 mg of $^{204}HgO$ and 2.29 mg of natural HgO were placed in a solution of glacial acetic acid and $H_2O$ having the relative molar concentration of 1 mole of glacial acetic acid to 66 moles of $H_2O \pm 20\%$. The platinum anode and the nickel cathode, connected to an appropriate power supply, were placed into the solution. Plating was carried at about 17 volts for 4.75 hours at 50 ma at about 25° C. Using potentiometric titration, it was determined that the remaining solution contained 0.0610 mg of mercuric ions. This represented a 97% yield of plated mercury.

Industrial Applicability

The invention described herein relates to a method for preparing mercury with an arbitrary isotopic distribution. Thus, this invention is applicable to devices which require mercury having a specific isotopic composition such as fluorescent lamps.

Equivalents

Those skilled in the art will recognize or be able to ascertain, using no more than routine experimentation, many equivalents to the specific embodiments of the invention described herein. Such equivalents are intended to be covered by the following claims.

We claim:

1. In a method for preparing quantities of mercury with a predetermined, arbitrary isotopic distribution, which comprises:

(a) forming an electrolyte solution, said electrolyte solution being comprised of glacial acetic acid and $H_2O$;

(b) dissolving a plurality of isotopes of HgO in said electrolyte solution; said plurality of isotopes being sufficient to supply the quantity and type of mercuric ions necessary to produce upon electrolyte reduction and plating said elemental mercury with a predetermined isotopic distribution;

(c) placing an anode and a cathode into the electrolyte solution;

(d) applying an electric voltage across the anode and cathode, said electric voltage creating an electric current from the anode through the electrolyte solution to the cathode, whereby mercuric ions are reduced and elemental Hg is plated onto said cathode.

(e) continuing to apply the electric voltage to said anode and cathode until the reduction of mercuric ions is completed; and (f) recovering said elemental mercury having the predetermined arbitrary isotopic distribution.

2. A method as recited in claim 1, wherein the electrolyte solution of glacial acetic and $H_2O$ in step "a" is in the relative molar concentration of 1 mole of glacial acetic acid/66 moles of $H_2O \pm 20\%$.

3. A method as recited in claim 1, wherein the cathode in step "c" is a metal selected from the group consisting of purified copper and nickel.

4. A method as recited in claim 1, wherein the isotopically specific quantities of mercuric ions reduced are submilligram quantities, in which a corresponding quantity of HgO is used.

5. A method as recited in claim 1, wherein the isotopically specific quantities of mercuric ions reduced are milligram quantities, in which a corresponding quantity of HgO is used.

6. A method for preparing mercury with a predetermined arbitrary isotopic distribution of Hg, which comprises:

(a) forming an electrolyte solution, said electrolyte solution being comprised of a mixture of glacial acetic acid and $H_2O$ in the relative molar concentration of 1 mole of glacial acetic acid/66 moles of $H_2O \pm 20\%$;

(b) dissolving a plurality of isotopes of HgO in said electrolyte solution; said plurality of isotopes being sufficient to supply the quantity and type of mercuric ions necessary to produce upon electrolyte reduction and plating said elemental mercury having a predetermined isotopic distribution;

(c) placing an anode and a cathode into the electrolyte solution, said cathode being a metal selected from the group consisting of purified copper and nickel;

(d) applying an electric voltage across said anode and cathode, said electric voltage creating an electric current flowing from the anode through the electrolyte solution to the cathode, whereby Hg ions are reduced and elemental Hg is plated onto said cathode, being determined by the I–V characteristic of the system;

(e) continuing to apply said electric voltage to said (f) recovering said elemental mercury having the predetermined, arbitrary isotopic distribution.

7. A method as recited in claim 6, wherein the isotopically specific quantities of mercuric ions reduced are submilligram quantities, in which a corresponding quantity of HgO is used.

8. A method as recited in claim 6, wherein the isotopically specific quantities of mercuric ions reduced are milligram quantities, in which a corresponding quantity of HgO is used.

9. A method for producing quantities of mercury with a predetermined arbitrary isotopic distribution of mercury, which comprises:

(a) forming an electrolyte solution, said electrolyte solution being comprised of concentrated HCl and $H_2O$;

(b) dissolving a plurality of isotopes of $Hg_2Cl_2$ in said electrolyte solution; said plurality of isotopes being sufficient to supply the quantity and type of mercuric ions necessary to produce upon electrolyte reduction and plating said elemental mercury having a predetermined isotopic distribution;

(c) placing an anode and a cathode into the electrolyte solution;

(d) applying an electric voltage to the anode and cathode, said electric voltage creating an electric current from the anode through the electrolyte solution to the cathode, whereby mercurous ions are reduced and elemental Hg is plated onto said cathode;

(e) continuing to apply the electric voltage to said electrolyte solution until the reduction of mercurous ions is completed; and (f) recovering said elemental mercury having the predetermined isotopic distribution.

10. A method as recited in claim 9, wherein the electrolyte solution of concentrated HCl and $H_2O$ in step "a" is in the relative molar concentration of 1 mole of HCl/57 moles of $H_2O \pm 20\%$.

11. A method as recited in claim 9, wherein the electric voltage in step "d" is 0.9 volts or higher as determined by the I–V characteristic of the system.

12. A method as recited in claim 9, wherein the cathode in step "c" is a metal selected from the group consisting of purified copper, nickel and Niron.

13. A method as recited in claim 9, wherein the quantities of isotopically specific mercurous ions to be reduced are submilligram quantities, in which a corresponding quantity of $Hg_2Cl_2$ is used.

14. A method as recited in claim 9, wherein the quantities of isotopically specific mercurous ions to be reduced are milligram quantities, in which a corresponding quantity of $Hg_2Cl_2$ is used.

15. A method for producing mercury with a predetermined, arbitrary isotopic distribution of mercury, which comprises:

(a) forming an electrolyte solution, said electrolyte solution comprising a mixture of concentrated HCl and $H_2O$ in the relative molar concentration of 1 mole of HCl/57 moles of $H_2O \pm 20\%$;

(b) dissolving a plurality of isotopes of $Hg_2Cl_2$ in said electrolyte solution, said plurality of isotopes being sufficient to supply the quantity and type of mercuric ions necessary to produce upon electrolytic reduction and plating said elemental mercury having a predetermined isotopic distribution;

from the group consisting of purified copper, nickel and Niron;

(d) applying an electric voltage to said anode and cathode, said electric voltage creating an electric current from the anode through the electrolyte solution to the cathode whereby mercurous ions are reduced and elemental mercury plates onto the cathode, said electric voltage being 0.9 volts or higher as determined by the I.V. characteristic of the system.

(e) continuing to apply the electric voltage to the electrolyte solution until the reduction of mercurous ions is completed; and (f) recovering said elemental mercury having the predetermined isotopic distribution.

16. A method as recited in claim 15, wherein the quantities of isotopically specific mercurous ions to be reduced are submilligram quantities, in which a corresponding quantity of $Hg_2Cl_2$ is used.

17. A method as recited in claim 15, wherein the quantities of isotopically specific mercurous ions to be reduced are milligram quantities, in which a corresponding quantity of $Hg_2Cl_2$ is used.

* * * * *